United States Patent [19]

Åhs

[11] Patent Number: 4,670,725

[45] Date of Patent: Jun. 2, 1987

[54] RELAY TONGUE UNIT

[75] Inventor: Wilgot Åhs, Koppom, Sweden

[73] Assignee: Tocksfors Verkstads AB, Tocksfors, Sweden

[21] Appl. No.: 796,431

[22] Filed: Nov. 8, 1985

[30] Foreign Application Priority Data

Nov. 13, 1984 [SE] Sweden ..... 8405690

[51] Int. Cl.[4] ..... H01H 61/01

[52] U.S. Cl. ..... 335/142; 200/275; 200/279; 335/196; 337/295

[58] Field of Search ..... 335/142, 196; 200/275, 200/279; 337/295

[56] References Cited

U.S. PATENT DOCUMENTS

| | | | |
|---|---|---|---|
| 2,120,421 | 6/1938 | Wagar | 335/196 X |
| 2,956,140 | 10/1960 | Walter | 335/135 |
| 3,900,709 | 8/1975 | Sheesley et al. | 200/275 X |

*Primary Examiner*—Arthur T. Grimley
*Assistant Examiner*—Jane K. Lau
*Attorney, Agent, or Firm*—Cushman, Darby & Cushman

[57] ABSTRACT

In a relay tongue unit intended to be included in an electric relay the unit comprises at least one tongue unit in the form of a resilient sheet consisting of an attaching member, which comprises a main portion (1), a fuse portion (2) and a transition portion (3), and a tongue portion (4). This has at its free end a contact (5) and a resistance portion.

3 Claims, 2 Drawing Figures

RELAY TONGUE UNIT

This invention relates to a relay tongue unit which is intended to be included in the form of one or more relay tongues in an electric relay.

The invention relates to a type of very simple relay tongues which are cheap to produce and simple to mount. In addition, in such a relay tongue unit according to the invention a fuse function together with a built-in series resistance is also obtained besides the relay function. The relay tongue unit according to the invention is thus a galvanically homogeneous unit.

As an example of the application field of the unit the automobile industry can be mentioned. One object thereof is to provide cheap reliable units, and efforts are made, considering the great number of relays included in a vehicle, to reduce the costs of the components in thr relay as well as the relay in its entirety.

As mentioned above a simplified and cheap component for a relay is obtained by means of the invention.

Figure 1:
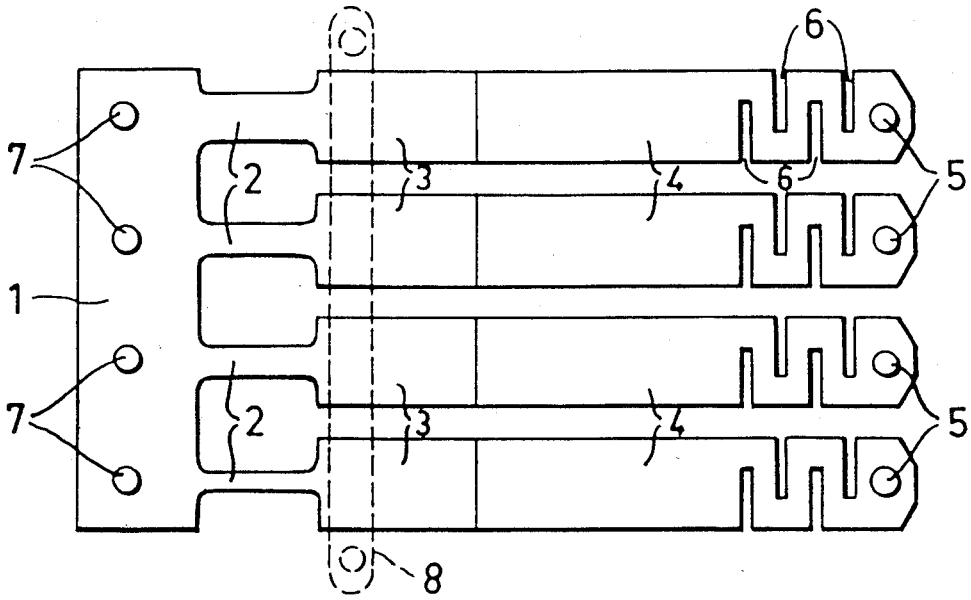
Figure 2:
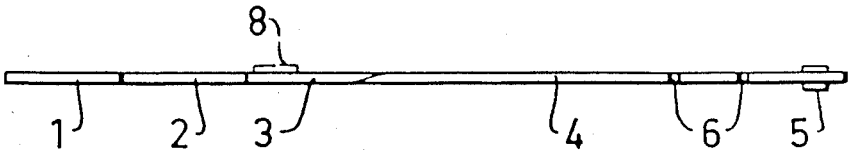

The invention will be described more in detail in the form of an example with reference to the drawing, in which FIG. 1 is a top plan view of the relay tongue unit according to the invention and FIG. 2 is a lateral view of the relay tongue unit.

In the example shown the relay tongue unit consists of four relay tongues. The unit consists of an attaching member comprising a main portion 1 and in the example shown four fuse portions 2 and four transition portions 3. Integral with the respective transition portion 3 there is arranged an extension forming four tongue portions 4 which each support a contact pin 5 at the free end.

In the example shown the attaching member (1,2,3) is punched from a plate of a suitable copper alloy suited for the electric conductivity purpose intended and the respective fuse portion 2 is characterized in that the material in this portion has been made narrower. Thus, the conductor cross section can be determined here depending on the current which is allowed to pass. In FIG. 1 an example is shown how three different values for blowing the fuse have been built into the relay tongue unit, whereby it is apparent from the figure that the two central fuse portions have the same rated value. Each tongue portion 4 consists e.g. of iron and is integral with the respective transition portion 3. The tongue portions have the same width and thickness as the transition portions. Each tongue portion is provided with four open cuts 6 alternately starting from opposite long sides of the tongue. In this way the material cross section along a "zigzag-shaped" distance is reduced, which means that the respective tongue has a built-in series resistance. The main portion 1 of the attaching member has attaching holes 7 by means of which the relay tongue unit can be screwed onto the relay. Moreover, the relay tongue unit is attached by means of a clamp 8 which can be screwed onto the relay, said clamp being arranged on top of the transition portion and locking this against a solid support of the relay. In this way the fuse portion 2 is prevented from being influenced by mechanical bending stresses.

If a fuse blows, i.e. is burnt off, the whole relay tongue unit can in a very simple way be rapidly exchanged for a new unit.

As is previously mentioned a galvanic homogeneous unit with relay function is obtained by means of the invention which has fuse function and series resistance at the same time. Therefore it is possible to eliminate in connection with e.g. a vehicle relay the separate fuses and resistors so far necessary e.g. in connection with a vehicle relay. All is built together to a simple handy unit. In principle a varying number of relay tongues can of course be unitarily built together in this way.

Within the scope of the invention the resistance portion can of course be formed in another simple way, e.g. instead of cuts 6 holes of suitable dimensions relative to the tongue width can be made in the tongue portion.

What is claimed is:

1. A relay tongue unit for an electric relay comprising a resilient sheet-like structure having opposite ends and at one end a main portion attachable to an electric relay, said main portion being common to and merging into a plurality of spaced apart fuse portions each of which is of lesser cross-sectional area than said main portion, at least one of said fuse portions having a cross-sectional area different from that of at least one other of said fuse portions, each fuse portion merging into a transition portion of greater cross-sectional area than the respective fuse portion, each transition portion merging into an elongated tongue portion which has generally uniform width along its length, said tongue portions having free ends forming said opposite end of said sheet-like structure and each carrying an electrical contact, each tongue portion having, between said free end and said transition portion, a resistance portion formed by a plurality of cut-outs in the material of said tongue portion.

2. A relay tongue unit as in claim 1 wherein said cut-outs are open-ended cuts extending transversely of the respective tongue portions and arranged alternately from one and the other side of the respective tongue portion.

3. A relay tongue unit for an electric relay comprising a resilient sheet-like structure having opposite ends and at one end a main portion having attaching holes therethrough so as to be attachable to an electric relay, said main portion being common to and merging into a plurality of spaced apart fuse portions each of which is of lesser cross-sectional area than said main portion, at least one of said fuse portions having a cross-sectional area different from that of at least one other of said fuse portions, each fuse portion merging into a transition portion of greater cross-sectional area than the respective fuse portion, each transition portion merging into an elongated tongue portion which has generally uniform width along its length, said main portion, fuse portions and transition portions being formed of a copper alloy and said tongue portions being formed of iron, said tongue portions having free ends forming said opposite end of said sheet-like structure and each carrying an electrical contact, each tongue portion having, between said free end and said transition portion, a resistance portion formed by a plurality of cut-outs in the material of said tongue portions, said cut-outs being open-ended cuts extending transversely of the respective tongue portions and arranged alternately from and the other side of the respective tongue portion.

* * * * *